US005103238A

United States Patent [19]

Mahnad

[11] Patent Number: 5,103,238

[45] Date of Patent: Apr. 7, 1992

[54] TWISTED Z OMNIDIRECTIONAL ANTENNA

[75] Inventor: Ali R. Mahnad, Carmichael, Calif.

[73] Assignee: Jampro Antennas, Inc., Sacramento, Calif.

[21] Appl. No.: 651,055

[22] Filed: Feb. 4, 1991

[51] Int. Cl.[5] ..... H01Q 21/26

[52] U.S. Cl. ..... 343/796; 343/806; 343/821

[58] Field of Search ..... 343/806, 796, 797, 859, 343/821, 822, 890; 333/26

[56] References Cited

U.S. PATENT DOCUMENTS 2,493,569 1/1950 Brown ..... 343/821
3,388,400 6/1968 Veldhuis ..... 343/797
4,180,820 12/1979 Johns ..... 343/797
4,223,315 9/1980 Alford ..... 343/890

*Primary Examiner*—Michael C. Wimer
*Attorney, Agent, or Firm*—Flehr, Hohbach, Test, Albritton & Herbert

[57] ABSTRACT

An omnidirectional antenna provides circular and elliptically polarized electromagnetic waves. The antenna constitutes first and second elements as the only radiating portions of the antenna. Each element has an elongated central portion parallel to each other, with ends bent at a predetermined slant angle above and below horizontal planes running through the central portions, and then with the ends themselves being at acute angles with respect to the central portion. The acute angles of the second element are in opposite orientation to the first. A proper balun is provided for driving the antenna.

14 Claims, 6 Drawing Sheets

TWISTED Z OMNIDIRECTIONAL ANTENNA

This is a continuation of application Ser. No. 335,008, filed Apr. 7, 1989, now abandoned.

BACKGROUND OF THE INVENTION

This invention relates generally to antennas for transmitting and receiving electromagnetic waves, and more particularly the invention relates to a circularly or elliptically polarized omnidirectional antenna having a balanced feed.

A number of antennas and antenna designs are known for transmitting RF electromagnetic signals. In FM radio broadcasting, for example, antennas are designed for broadcasting in a frequency range of 88 MHz to 108 MHz in channels of 200 KHz width. The antennas are typically omnidirectional for broadcast in all directions, although directional antennas are known and can be employed where directivity is desired.

In addition to providing an antenna designed to accomplish omnidirectional broadcast of a circularly-polarized wave, the feed of electrical signals to the radiating elements is important in providing balanced excitation to the radiating elements, minimal excitation of the support structure and other nonradiating elements, and generally efficient power transfer from input power to radiated power.

The present invention is directed to an improved omnidirectional antenna and feed for efficiently providing a balanced drive to the radiating elements of the antenna.

SUMMARY OF THE INVENTION

An object of the present invention is an improved omnidirectional antenna for transmitting circularly and elliptically polarized electromagnetic waves.

Another object of the invention is an antenna and feed system for providing a balanced energization of the antenna radiating elements.

Yet another object of the invention is antenna operation which restricts radiation to the radiating elements and eliminates spurious radiation.

Another object of the invention is to maximize the operational bandwidth of an antenna by using multiple resonating elements A feature of the invention is a radiating element configured in a generally twisted Z shape.

Another feature of the invention is a balun which provides a balanced drive to the antenna and also provides a support structure for the antenna Briefly, an antenna in accordance with the invention includes an or first element, a parasitic or second element and a balun for driving the antenna from a coaxial, transmission line. The active and parasitic (first and second) elements are mounted in alignment in a 180° rotated mirror-image arrangement. Each element has a generally twisted Z configuration with a central portion and arm extensions at either end. In a preferred embodiment, the arms are at 45° with respect to the central portion and at 23° with respect to a plane through the central portion for optimum circular polarization.

The balun comprises part of the antenna support structure and includes a coaxial feed line and a parallel coaxial line stub. Ends of the feed line and the coaxial stub are arranged in spaced alignment with a gap therebetween. The inner conductor of the coaxial feed line is extended across the gap to the center conductor of the parallel coaxial stub. The inner and outer conductors of the parallel coaxial line are shorted, and the outer conductors of the two coaxial lines are also shorted. The positions of the shorts are determined by known techniques for optimum bandwidth match.

The midpoints of the central portions of the active and parasitic elements are respectively shorted to the outer conductors of the coaxial feed line and to the parallel coaxial stub.

The radiating arms of the antenna elements comprise electrical conductors of straight or curved configuration. A plurality of pairs of arms can be provided in each antenna element for multiple-frequency operation.

The invention and objects and features thereof will be more readily apparent from the following detailed description and appended claims when taken with the drawing.

DETAILED DESCRIPTION OF ILLUSTRATIVE EMBODIMENTS

Figure 1:
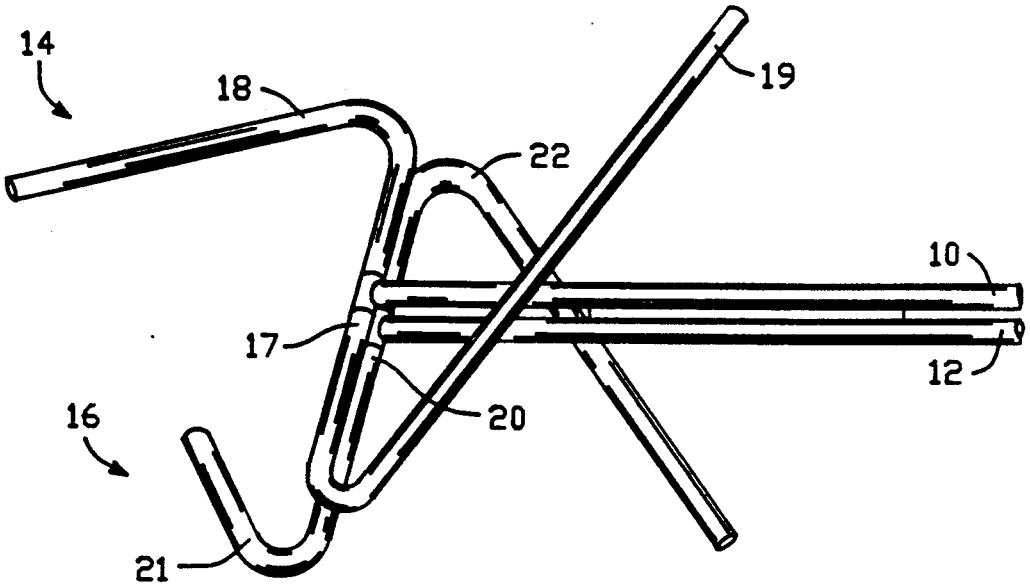
FIG. 1 is a perspective view of an omnidirectional antenna in accordance with one embodiment of the invention.

Referring now to the drawing, FIG. 1 is a perspective view of an omnidirectional antenna in accordance with one embodiment of the invention. The antenna includes a support structure comprising rigid coaxial cables 10 and 12 in which cable 10 provides an input to the antenna while cable 12 functions as a stub which cooperatively functions with the input transmission line 10 in feeding an active or first element 14 and a parasitic or second element 16, as will be described further hereinbelow with reference to FIG. 5. The active element 14 includes a horizontal central portion 17 and arms 18 and 19 at either end of the central portion 17. Similarly, the parasitic element 16 includes a central portion 20 with radiating arms 21 and 22 at either end thereof. The active and parasitic elements are arranged as 180° rotated mirror images. Both an active and parasitic element are needed for proper operation of the antenna.

In a preferred embodiment, the arms at either end of the two central portions 17, 20 make a 45° angle with the central portion, and each arm makes a 22.5° angle with a plane through the central portion. In effect, each of the active and parasitic elements is a twisted Z. The 22.5° angle results in a near-optimum circular polarization of a radiated wave, but the angle can be changed to produce elliptical polarization if desired.

Figure 2:
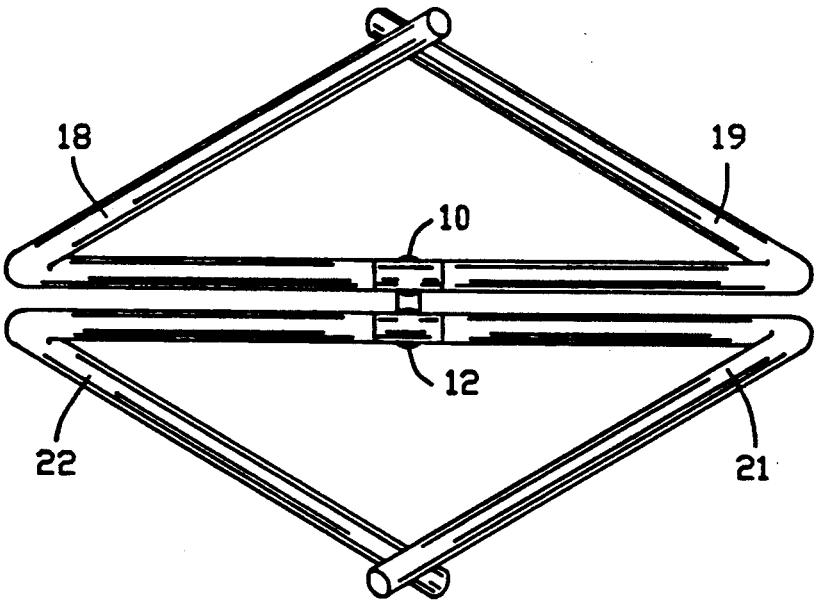
FIGS. 2, 3, and 4 are front, side, and top views of the antenna of FIG. 1.
Figure 3:
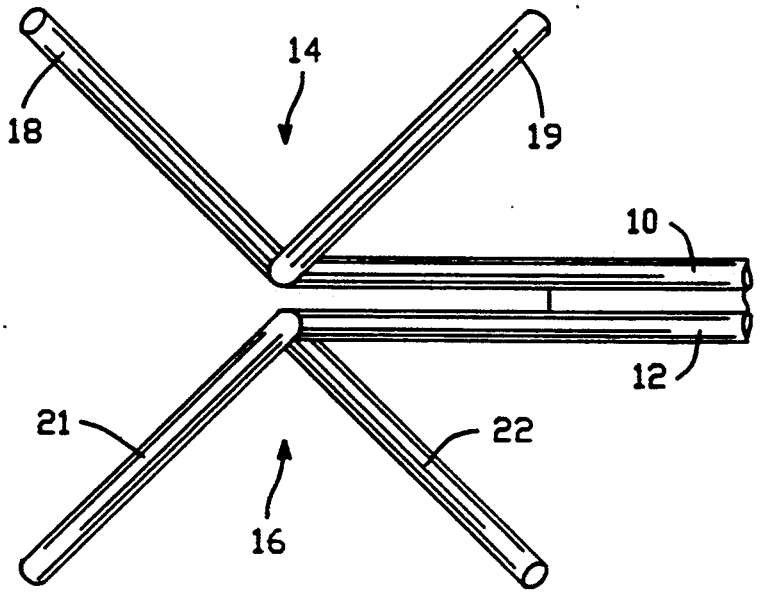
Figure 4:
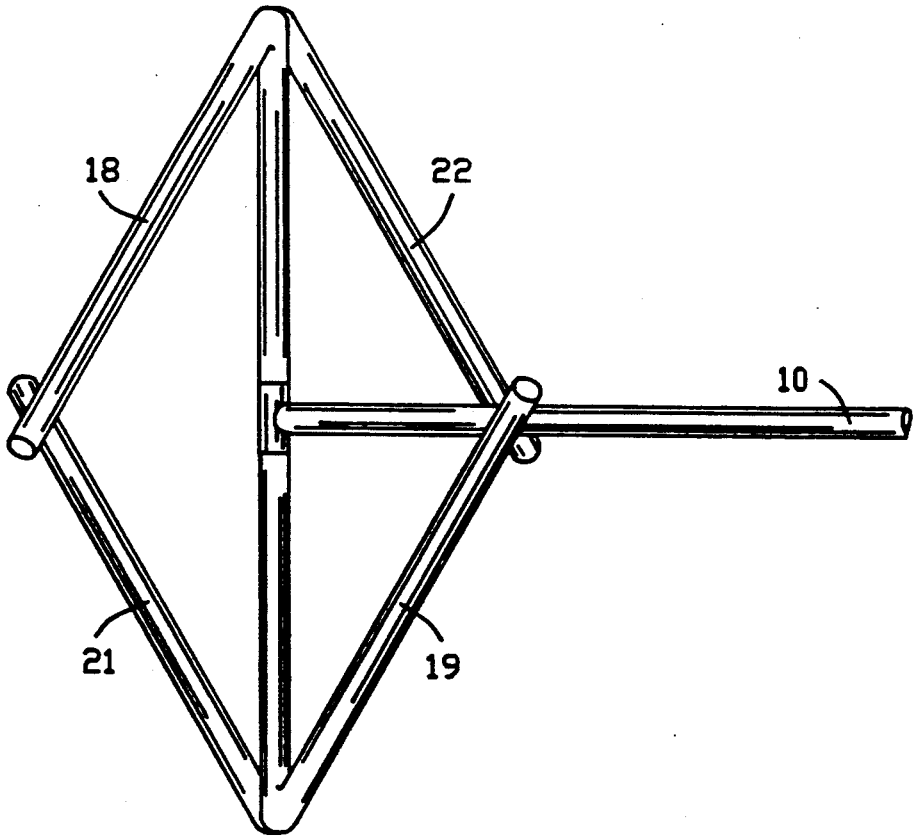

FIGS. 2, 3 and 4 are front, side and top views of the antenna of FIG. 1. When viewed from the front as in FIG. 2, the radiating arms of the active element extend upward and the sense of polarization of the radiation is determined by the right- or left-hand rules. That is, if the edge of one's hand is aligned with the horizontal central portion, the fingers of either the right hand or the left hand will curve in the direction of an extending arm; that is, for the active element 14 the fingers of the right hand curve in the direction of arms 18 (and 19) when the edge of the hand is aligned with the central portion 17 and the fingers point toward arm 18 (or towards arm 19). The left hand rule applies to the parastic element 16. The active and parasitic elements have the same sense of direction.

Figure 5:
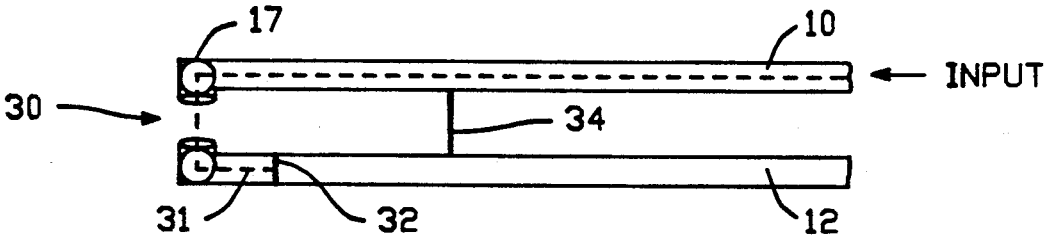
FIG. 5 is a side view of the balun support structure for the antenna of FIG. 1.

FIG. 5 illustrates the balun function of the support coaxial cable in providing a balanced feed to the active and parasitic elements from an unbalanced coaxial line. The design of an optimum balun is well established; see for example Altman "The Compensated Balun," *IEEE Transactions AP*, March 1960, pp. 112 et seq. Coaxial line 10 provides the input signal to the antenna, with the coaxial line 12 providing a matching stub for the termination. The two coaxial cables are bent at one end with the ends of the cables facing each other across a gap as shown at 30. The center conductor 31 of transmission line 10 extends across gap 30 and is connected to the center conductor (dotted line) of transmission line 12 which is shorted at 32. Further, the outer conductors of the transmission lines 10, 12 are shorted at 34. The positions of the shorts are determined by known techniques for optimum bandwidth. The central portion 17 of the active element is shorted at the mid-point to the outer conductor of transmission line 10, and the central portion 20 of the parasitic element is shorted at the mid-point to the outer conductor of transmission line 12. Thus, the balun forms a portion of the support structure for the antenna while providing a balanced drive to the active and parasitic elements.

Figure 6:
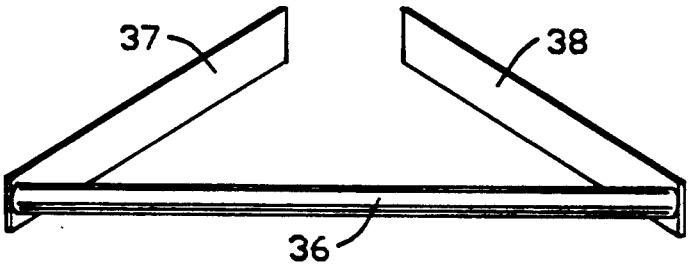
FIG. 6 is a side view of an antenna element in accordance with another embodiment of the invention.
Figure 7:
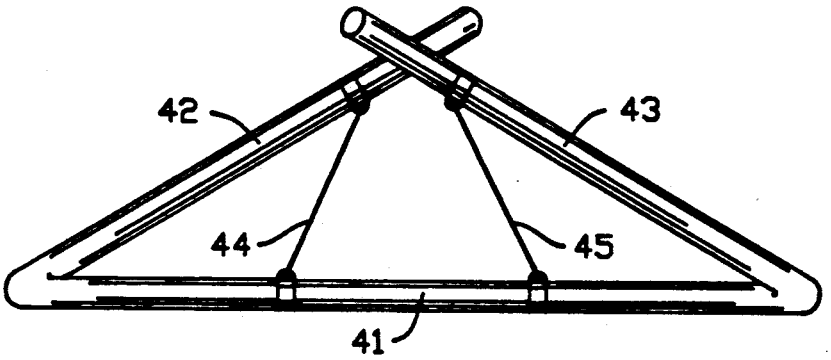
FIG. 7 is a side view of an antenna element in accordance with another embodiment of the invention.
Figure 8:
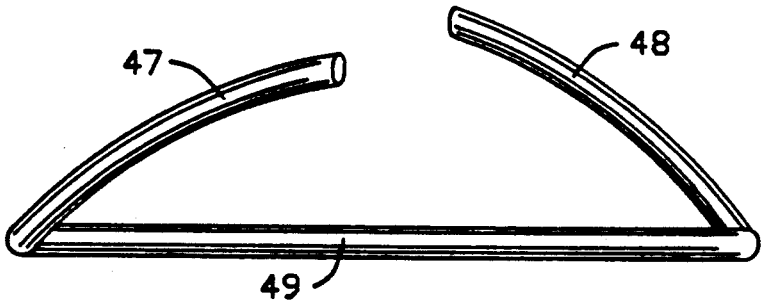
FIG. 8 is a side view of an antenna element in accordance with another embodiment of the invention.

In the embodiment of FIGS. 1–5, the active and parasitic elements are formed from rigid tubing having straight arms. However, other embodiments of the antenna can be provided as illustrated in FIGS. 6–10. In FIG. 6, the antenna element includes a tubular central portion 36 with planar arms 37 and 38. In FIG. 7, the central tubular portion 41 has adjustable tubular arms 43 and 44 supported at either end by adjustable "wishbone" support rods 44 and 45. In FIG. 8, the antenna element has curved tubular arms 47 and 48 joined at either end to the central tubular portion 49.

Figure 9:
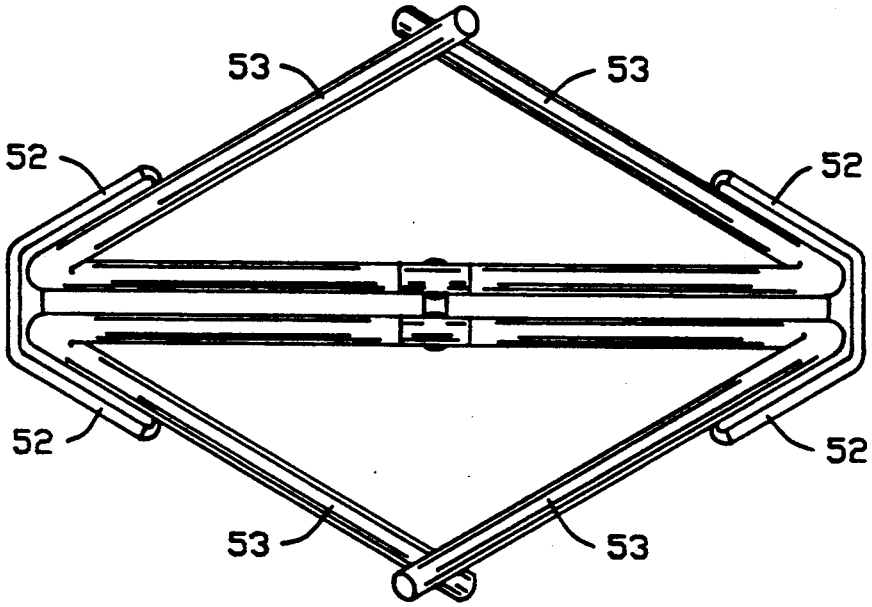
FIG. 9 is a perspective view of an antenna in accordance with another embodiment of the invention.

The embodiment of the antenna of FIGS. 1–5 can be modified for broadband operation as shown in FIG. 9 with the addition of parasitic sleeves 52 which are flat or curved pieces of conductors placed in close proximity to each arm 53. The sleeves comprise part of a unitary structure which is positioned between and shorts the sleeves over the gap between the horizontal bars of the antenna elements. The length and width and the manner of shorting the sleeves are frequency-dependent and are determined empirically or by the use of network equivalent circuits.

Figure 10:
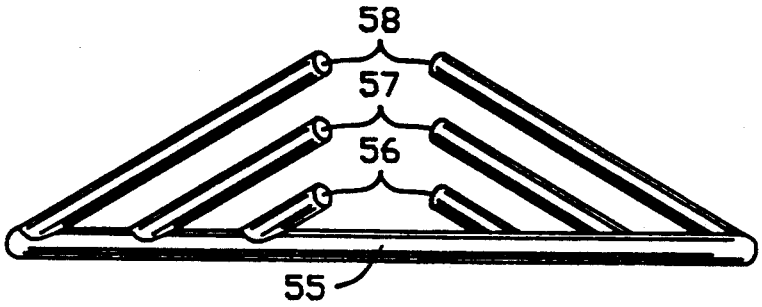
FIG. 10 is a side view of an antenna element in accordance with another embodiment of the invention.

Alternatively, a broadband antenna can be provided by including a plurality of pairs of radiating arms on each central portion as illustrated in FIG. 10. In this embodiment, the central tubular portion 55 supports radiating pairs of arms 56, 57, and 58 with the lengths of the arms and positions of the arms on the central portion 55 determined by the operating frequencies thereof.

Consider now the theory of operation of the omnidirectional antenna in accordance with the invention. As to the radiation characteristics, a close inspection of the radiating element (antenna) indicates that the only radiating parts of the antenna are the four arms. Other parts are balanced structure and closely bound electromagnetic waves. The four radiating arms can be viewed as four current elements in a cylindrical arrangement. In general, each arm is a slant element which, say, makes an angle $\gamma$ with respect to horizontal. The components of the current elements in vertical and horizontal directions are $$I_v = I \operatorname{Sin}\gamma \qquad (1)$$
$$I_H - I \operatorname{Cos}\gamma$$

Radiation equations have been derived for vertical and horizontal current elements around perfectly conducting structure. See P.S.Carter,, *Proceedinos of the IRE*, December 1943. Using these results for the case of four in-phase vertical current elements of unit strength one gets:

$$E_\theta = 4\operatorname{Sin}\theta\{Jo(Kb\operatorname{Sin}\theta) + 2J_4(Kb\operatorname{Sin}\theta) + 2J_8(Kb\operatorname{Sin}\theta) + \ldots\} \qquad (2)$$

Eg.2 is obtained by letting the radius of the conducting cylinder approach zero.

A first order approximation to (2) is:

$$E\theta \simeq 4 \operatorname{Sin}\theta J_o(Kb \operatorname{Sin}\theta) \qquad (3)$$

where $\theta$ is polar angle from vertical axis and $J_o$ is the Bessel function of the zeroth order and $$K = \frac{2\pi}{\lambda}$$

and b is the radius of the array of current elements. In the present case:

$$b = \frac{\lambda}{8} \qquad (4)$$

or $$Kb = \frac{\pi}{4} \qquad (5)$$

Similarly for the case of four horizontal current elements:

$$E_\Phi = \qquad (6)$$
$$-j4\{-J_1(Kb\operatorname{Sin}\theta) + \{J_3(Kb\operatorname{Sin}\theta) - J_4(Kb\operatorname{Sin}\theta)\}\operatorname{Cos}4_\Phi + \ldots\}$$

Figure 11:
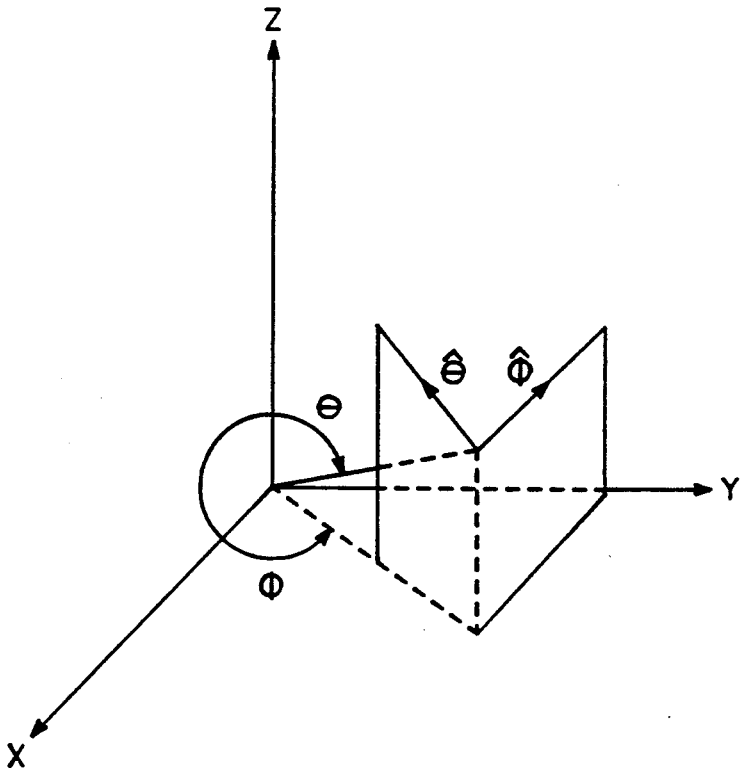
FIG. 11 is an illustration of the coordinate system used in describing the theory of operation of an antenna in accordance with the invention.
Figure 12:
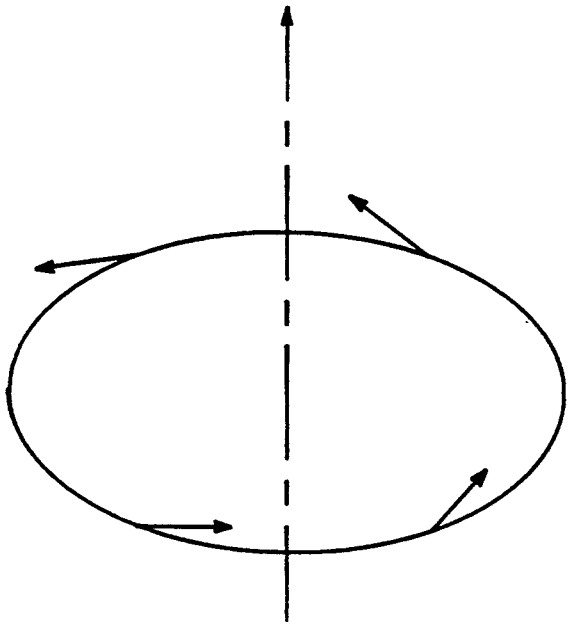
FIG. 12 illustrates the direction of slant current elements for a right-hand cylindrical coordinate system.

This equation is based on the coordinate system shown in FIG. 11 and the slant current elements shown in FIG. 12.

The first order approximation is:

$$E_\Phi \simeq j4J_1\left(\frac{\pi}{4}\operatorname{Sin}\theta\right) \qquad (7)$$

It is noted that in the case of a horizontal current element, the radiated field contains $E_{74}$ component also. However, it can be shown that the magnitude of this component is significantly smaller than EO and is of the order of the terms that are ignored in the above approximations.

Furthermore, equations (3) and (7) are true for unit current elements. For the slant unit current element:

$$E_\theta = 4\text{Sin}\gamma\text{Sin}\theta\, J_o\left(\frac{\pi}{4}\text{Sin}\theta\right) \tag{8}$$

$$E_\Phi = j4\text{SinCos}\gamma J_1\left(\frac{\pi}{4}\text{Sin}\theta\right) \tag{9}$$

Then $$= \frac{E_\theta}{E_\phi} = -j\tan\gamma\,\frac{J_o\left(\frac{\pi}{4}\text{Sin}\theta\right)}{J_1\frac{\pi}{4}\text{Sin}\theta)}\text{Sin}\theta \tag{10}$$

in the horizontal plane ($\theta=90°$) and $$\frac{E_\theta}{E_\phi} = -j\,2.356\tan\gamma \tag{11}$$

In a right-hand cylindrical coordinate system (FIG. 11), an ideal right-hand circularly polarized wave requires:

$$\frac{E_\theta}{E_\phi} = -j \tag{12}$$

This leads to $$\gamma=23° \tag{13}$$

This implies that if the slant angle of the arms with respect to the horizontal plane is set to substantially 23 degrees, the resulting radiation if right-hand circularly polarized in the horizontal plane. From (10) and (13):

$$\text{axial ratio} = \left|\frac{E_\theta}{E_\phi}\right| \cong 0.425\,\frac{J_o\left(\frac{\pi}{4}\text{Sin}\theta\right)}{J_1\left(\frac{\pi}{4}\text{Sin}\theta\right)}\text{Sin}\theta$$

Figure 13:
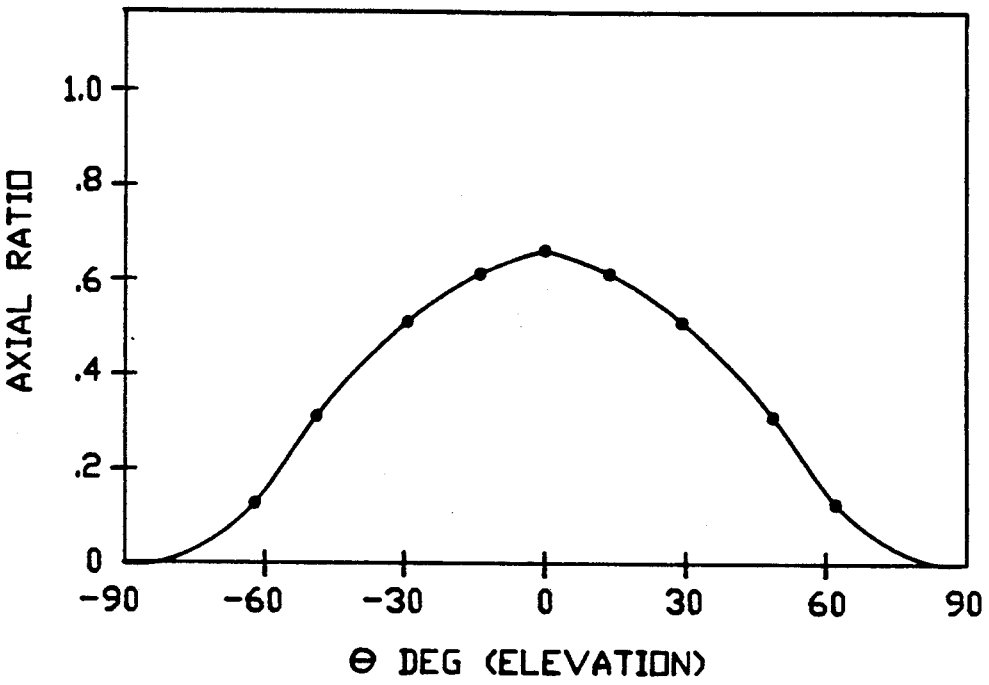
FIG. 13 is a graph illustrating the variation of axial ratio as a function of elevation angle.

FIG. 13 shows the variation of axial ratio as a function of $\theta$ (elevation angle). This figure indicates that the radiation is circularly polarized even at high elevation angles.

Figure 14:
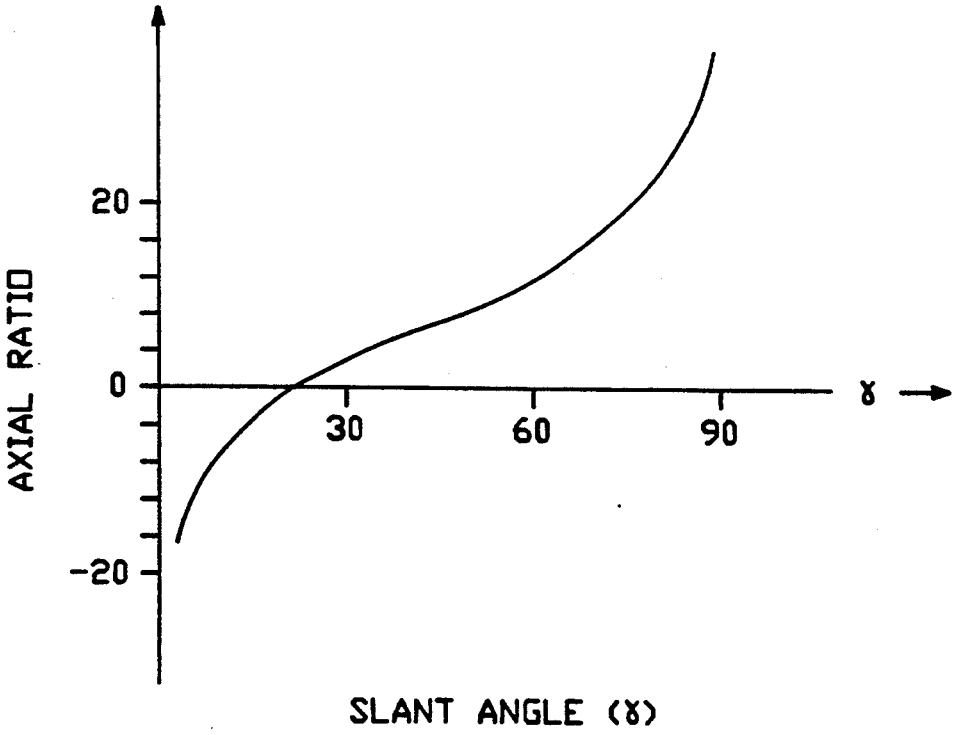
FIG. 14 is a graph illustrating the variation of axial angle as a function of slant element angle.

FIG. 14 shows the variation of axial ratio as a function of slant element angle $\gamma$. From Equation 11:

$$\text{Ar}=2.356\tan\gamma \tag{4}$$

Elevation patterns of the antenna at each polarization are given by (8) and (9), but a simpler equation is obtained by replacing the Bessel functions by their small argument expansions. Then:

$E_{74}\gamma\text{Sin}\theta$ $E_{74}\gamma Sin\phi$ which indicates a sine pattern for both vertical ($E\phi$) and horizontal ($E\phi$) polarization. The aximuth patterns are independent from $\phi$, which indicates an omnidirectional pattern.

The input impedance of the antenna can be measured at the input to the balun, and the impedance at the feed point (gap 30 in FIG. 5) can be computed using standard transmission line equations. The impedance at the feed point depends on the size and separation of horizontal central rods (17 and 20). Since these lines act as a parallel transmission line, the arm impedances may be calculated using transmission line equations. The parallel transmission lines extend ⅛ wavelength on each side of the feed. It can be shown that if the impedance at each end of the parallel lines is of the form:

$$Z_o = A - i\sqrt{1-A^2}$$

The impedance at the feed point (6) is real and equal to:

$$Z_f = Z_o\left\{\frac{1+\sqrt{1-A^2}}{2A}\right\}$$

where $Z_o$ is the characteristic impedance of the parallel line and is compared using $$Z_o = 120\,\text{Ln}\left(\frac{D}{d}+\sqrt{\frac{D^2}{d^2}-1}\right)$$

where d is the outer diameter of each rod and D is the center-to-center separation of the two rods.

A prototype has been built to measure the arm impedances. The antenna was made of 1.625" (OD) copper tube. Arm lengths were substantially ¼ wavelength, and total length of the horizontal bar was also substantially ¼ wavelength. The separation between the horizontal bar was chosen to give $Z_o=170\Omega$. The input impedance at the feed was computed to be 37Ω which results in a dipole impedance of:

$$D=125-j\,113.4\Omega$$

Once this impedance is known, the parallel line may be designed to transform this to 50Ω impedance at the feed point. This may also be accomplished by the use of transformers in the balun. Fine-tuning of the antenna may be accomplished by adjusting of the arm lengths and by the movement of the shorts in the balun.

There has been described an improved antenna for transmitting omnidirectional circularly or elliptically polarized waves. The balun provided with the antenna restricts radiation to the radiating elements and eliminates spurious radiation. Operational bandwidth of the antenna elements can be maximized by using multiple resonance techniques and through use of parasitic sleeves and multiple pairs of radiating arms, for example. Advantageously, the feed line and balun structure of the antenna can be incorporated in the support structure for the antenna.

While the invention has been described with reference to specific embodiments, the description is illustrative of the invention and is not to be construed as limiting the invention. Various modifications and applications may occur to those skilled in the art without departing from the true spirit and scope of the invention as defined by the appended claims.

I claim:

1. An omnidirectional antenna comprising a first element for receiving an input signal, including a central portion elongated along an axis and having opposing ends, first and second arms attached to said opposing ends at a predetermined acute angle with respect to said axis of said elongated central portion, said central portion lying in a horizontal plate with said opposing ends having a predetermined slant angle above said plane but in opposite directions whereby said first element is configured generally as a twisted Z, a second element including a central portion, elongated along an axis and supported in spaced parallel alignment with said axis of said central portion of said first element; and having opposing ends, first and second arms attached to said opposing ends at said predetermined acute angle with respect to said axis of said elongated central portion of said second element, said central portion of said second element lying in a horizontal plane with said opposing ends having said predetermined slant angle below such plane and having said acute angle with respect to such central portion but in an opposite orientation compared to said opposing ends of said first element whereby said second element is configured generally as a twisted Z, said first and second elements constituting the only radiating portions of said antenna, which provide said omnidirectional characteristic, and means for energizing said elements.

2. The omnidirectional antenna as defined by claim 1 wherein said means for energizing said first element and said second element comprises balun means for providing a balanced drive from an unbalanced feed line.

3. The omnidirectional antenna as defined by claim 2 wherein said balun means further provides structural support for both said elements.

4. The omnidirectional antenna as defined by claim 3 wherein said balun means further comprises a first rigid coaxial transmission line having an outer conductor and an inner conductor for transmitting an electrical signal to said antenna, a second rigid coaxial transmission line having an outer conductor and an inner conductor, said first and second transmission lines being in parallel alignment with ends thereof configured to be in spaced alignment with a gap therebetween, said inner conductor of said first transmission line being connected to said inner conductor of said second transmission line across said gap, means for shorting said inner conductor of said second transmission line to said outer conductor of said second transmission line within said second transmission line, means for shorting the outer conductor of said first transmission line to the outer conductor of said second transmission line, said central portion of said first element being electrically and physically attached to said outer conductor of said first transmission line, and said central portion of said second element being electrically and physically attached to said outer conductor of said second transmission line.

5. The omnidirectional antenna as defined by claim 4 wherein the positioning of shorts of said inner and outer conductors of said second transmission line and the positioning of the short of said outer conductor of said first and second transmission lines are selected for a desired bandwidth match.

6. The omnidirectional antenna as defined by claim 1 wherein said first and second arms of said first element and of said second element are at an acute angle of 45° with respect to said elongated central portions.

7. The omnidirectional antenna as defined by claim 6 wherein said first and second arms of said first element and of said second element are at a slant angle of approximately 23° with respect to parallel horizontal planes through said elongated central portions.

8. The omnidirectional antenna as defined by claim 1 wherein said elongated central portions and said first and second arms are cylindrical.

9. The omnidirectional antenna as defined by claim 8 wherein said arms are straight.

10. The omnidirectional antenna as defined by claim 8 wherein said arms are curved.

11. The omnidirectional antenna as defined by claim 1 wherein said elongated central portions are cylindrical and said first and second arms are planar.

12. The omnidirectional antenna as defined by claim 1 and further including parasitic sleeves positioned in spaced alignment with said arms to provide broadband frequency operation.

13. The omnidirectional antenna as defined by claim 12 wherein said sleeves comprise part of a unitary structure positioned between said elongated central portions with said sleeves extending therefrom at either end.

14. The omnidirectional antenna as defined by claim 1 wherein each of said elements includes a plurality of pairs of arms positioned along the length of said elongated central portion, the positions and lengths of said pairs of arms being selected to provide multiple operating frequencies for said antenna.

* * * * *